US009090116B2

(12) United States Patent
Tunis et al.

(10) Patent No.: US 9,090,116 B2
(45) Date of Patent: Jul. 28, 2015

(54) ARMORED WHITEBOARD DEVICE

(71) Applicant: Hardwire, LLC, Pocomoke City, MD (US)

(72) Inventors: George Tunis, Ocean City, MD (US); Scott Kendall, Berlin, MD (US); Emily Heinauer, Arlington, VA (US)

(73) Assignee: Hardwire, LLC, Pocomoke City, MD (US)

( * ) Notice: Subject to any disclaimer, the term of this patent is extended or adjusted under 35 U.S.C. 154(b) by 143 days.

(21) Appl. No.: 13/832,922

(22) Filed: Mar. 15, 2013

(65) Prior Publication Data

US 2014/0199678 A1 Jul. 17, 2014

Related U.S. Application Data

(63) Continuation-in-part of application No. 29/446,050, filed on Feb. 20, 2013, now Pat. No. Des. 687,100, and a continuation-in-part of application No. 29/446,070, filed on Feb. 20, 2013, now Pat. No. Des. 694,332, and a continuation-in-part of application No. 29/446,073, filed on Feb. 20, 2013, now Pat. No. Des. 694,333.

(60) Provisional application No. 61/753,177, filed on Jan. 16, 2013.

(51) Int. Cl.

| | |
|---|---|
| ***B43L 1/00*** | (2006.01) |
| ***F41H 5/08*** | (2006.01) |
| *A63B 69/26* | (2006.01) |

(52) U.S. Cl.

CPC ... *B43L 1/00* (2013.01); *F41H 5/08* (2013.01); *A63B 69/26* (2013.01)

(58) Field of Classification Search

USPC ..... 434/408

See application file for complete search history.

(56) References Cited

U.S. PATENT DOCUMENTS

| | | | |
|---|---|---|---|
| D23,933 | S | 1/1895 | Odgers |
| 1,361,678 | A | 12/1920 | Buck |
| D164,008 | S | 7/1951 | Loyd |
| 4,648,189 | A | 3/1987 | Michel |
| D298,489 | S | 11/1988 | Sornborger |
| D354,087 | S | 1/1995 | Dunlap et al. |
| 5,422,155 | A | 6/1995 | Spence, Jr. |
| 5,527,568 | A | 6/1996 | Boone et al. |
| D535,256 | S | 1/2007 | Fort et al. |
| D623,693 | S | 9/2010 | Hoch et al. |
| D677,257 | S | 3/2013 | Andre et al. |

OTHER PUBLICATIONS

HB26 Product Specification Sheet, Dyneema, Jun. 2011.
HB50 Product Specification Sheet, Dyneema, Jun. 2011.
BT10 Product Specification Sheet, Dyneema, Jun. 2011.
Ballistic Resistance of Body Armor, NIJ Standard-0101.06, US Department of Justice, Office of Justice Program, National Institute of Justice, Jul. 2008.

*Primary Examiner* — Timothy A Musselman
(74) *Attorney, Agent, or Firm* — Posternak Blankstein & Lund LLP

(57) ABSTRACT

An armored whiteboard device is provided having a strike face with a dry erase markable surface that can be written on and wiped clean, and a protection layer of ballistic material attached to the strike face. The strike face and the ballistic protection layer can be used as a defensive shield to protect against oncoming ballistic projectiles. Handles on one side allow the device to be held in one position for writing upon the markable surface and in another position for protection against penetration by a projectile.

24 Claims, 12 Drawing Sheets

ARMORED WHITEBOARD DEVICE

CROSS REFERENCE TO RELATED APPLICATIONS

This application claims the benefit under 35 U.S.C. §119 (e) of U.S. Provisional Patent Application No. 61/753,177, filed on Jan. 16, 2013, the disclosure of which is incorporated by reference herein.

This application claims the benefit under 35 U.S.C. §120 of U.S. Design Patent Application Ser. No. 29/446,050, filed on Feb. 20, 2013, U.S. Design Patent Application Ser. No. 29/446,070, filed on Feb. 20, 2013, and U.S. Design Patent Application Ser. No. 29/446,073, filed on Feb. 20, 2013, the disclosures of all of which are incorporated by reference herein.

STATEMENT REGARDING FEDERALLY SPONSORED RESEARCH OR DEVELOPMENT

N/A

BACKGROUND OF THE INVENTION

A whiteboard is a flat surface having a high smoothness or glossiness that can be written upon or otherwise marked using a non-permanent marker and then wiped clean. Other terms for such a whiteboard include dry erase board and dry erase whiteboard. Whiteboards have become ubiquitous in classrooms, offices, and other institutions.

SUMMARY OF THE INVENTION

An armored whiteboard device is provided that can be used as both a whiteboard and a protective device for ballistic projectiles.

The armored whiteboard device includes a markable surface that can form all or part of a strike face and a ballistic protection layer attached to the strike face. Handles on one side allow the device to be held in one position for writing upon the markable surface and in another position for protection against penetration by a projectile. A markable surface can be provided on both sides of the whiteboard device.

DESCRIPTION OF THE DRAWINGS

The invention will be more fully understood from the following detailed description taken in conjunction with the accompanying drawings in which.

DETAILED DESCRIPTION OF THE INVENTION

The disclosures of U.S. Provisional Patent Application No. 61/753,177, filed on Jan. 16, 2013, U.S. Design Patent Application Ser. No. 29/446,050, filed on Feb. 20, 2013, U.S. Design Patent Application Ser. No. 29/446,070, filed on Feb. 20, 2013, and U.S. Design Patent Application Ser. No. 29/446,073, filed on Feb. 20, 2013, are all incorporated by reference herein.

Figure 1:
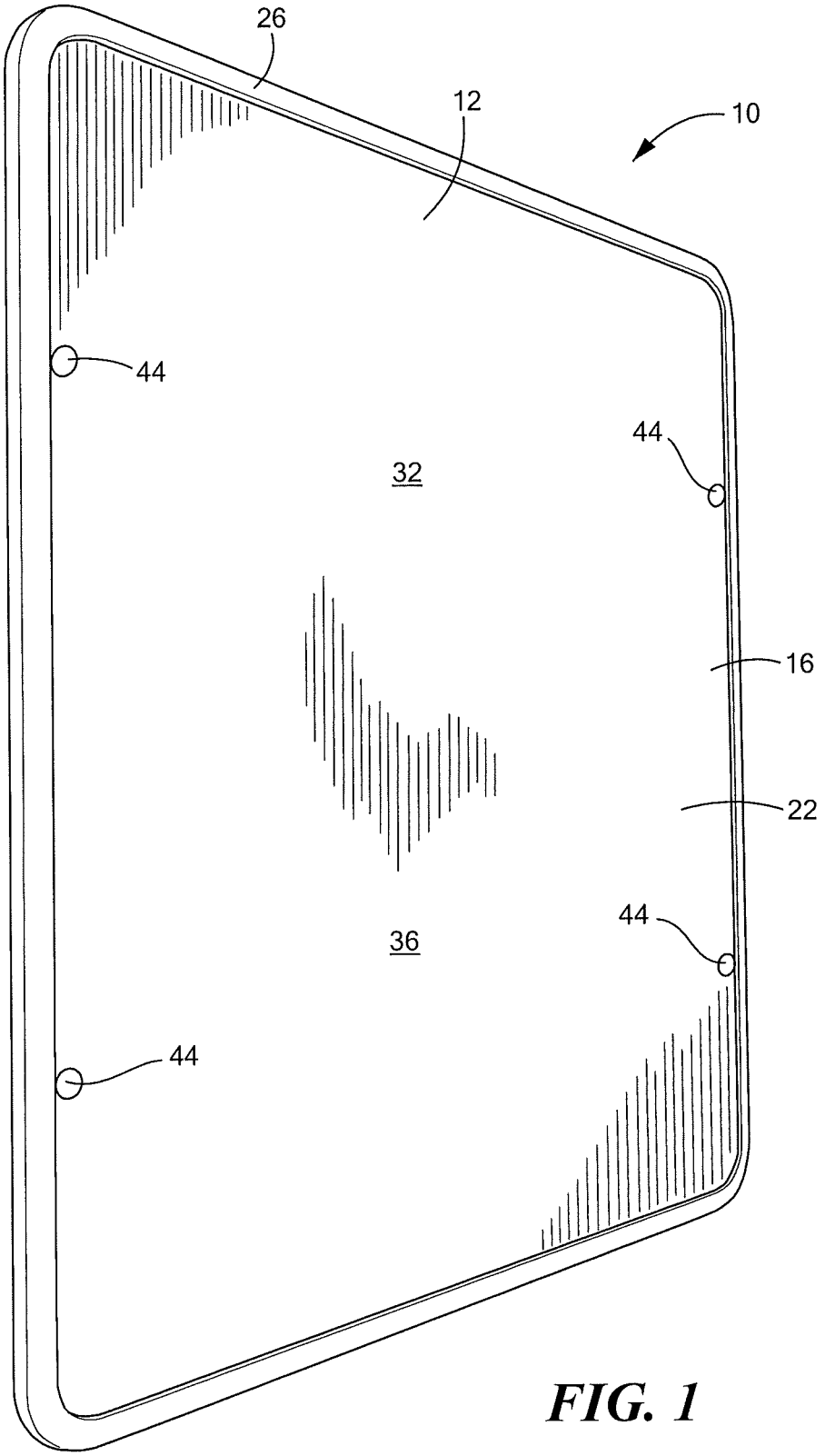
FIG. 1 is a front perspective view of an embodiment of an armored whiteboard device according to the present invention.
Figure 2:
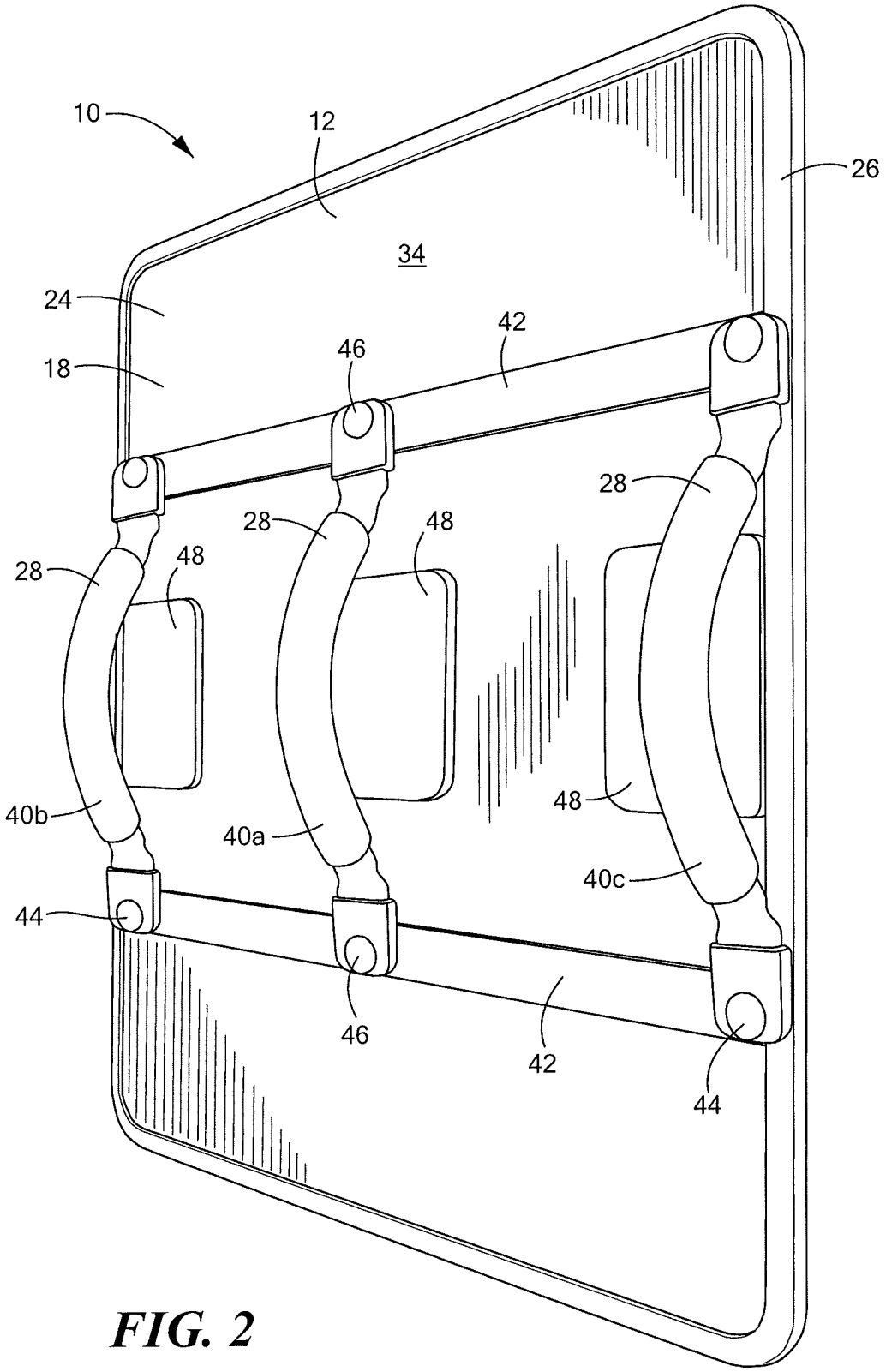
FIG. 2 is a rear perspective view of the armored whiteboard device of FIG. 1.
Figure 3:
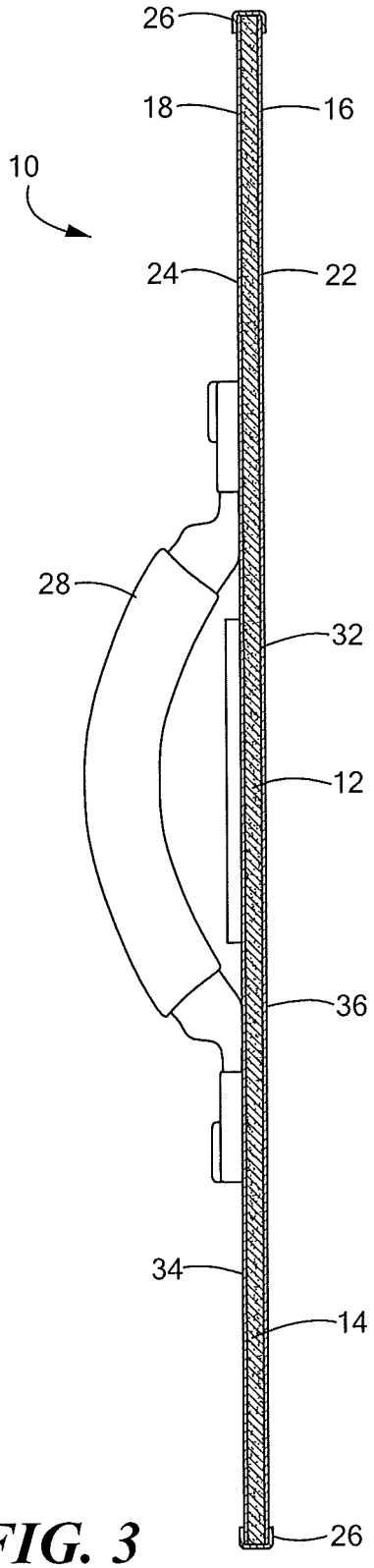
FIG. 3 is a cross sectional view of the armored whiteboard device of FIG. 1.

Referring to one embodiment illustrated in FIGS. 1-3, an armored whiteboard device 10 is a planar device 12 comprising a layered arrangement including a protection layer 14 of ballistic material interposed between two opposed flat surface layers 16, 18 on opposite parallel sides 22, 24 of the planar device. The surface layer 16 on at least one side 22 includes a markable surface 32. An edging 26 surrounds the periphery of the planar device 12. One or more handles 28 are provided on the other side 24. The surface layer 18 can also include a markable surface 34.

Figure 6:
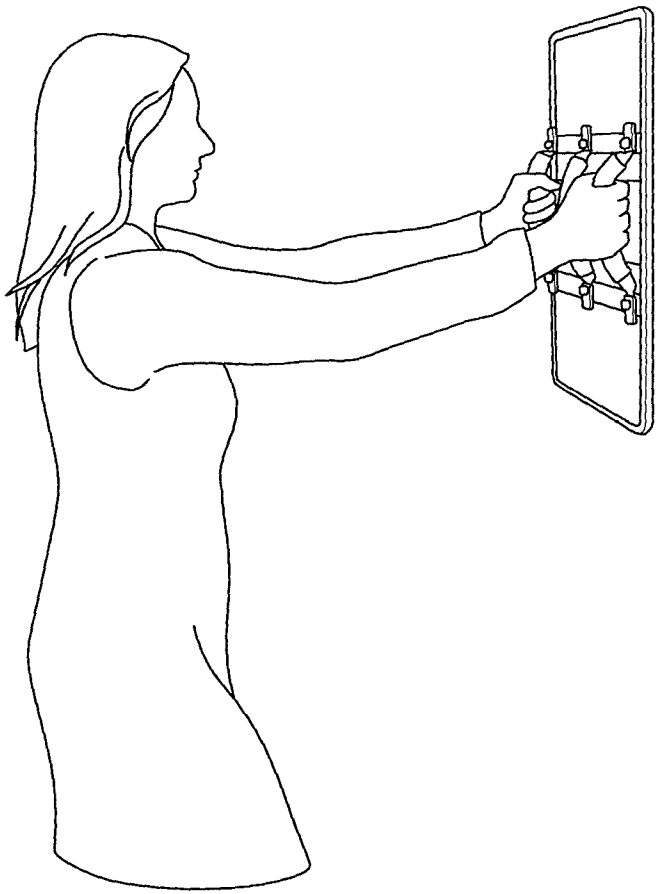
FIG. 6 is an illustration of an armored whiteboard device used as a protective device.
Figure 5:
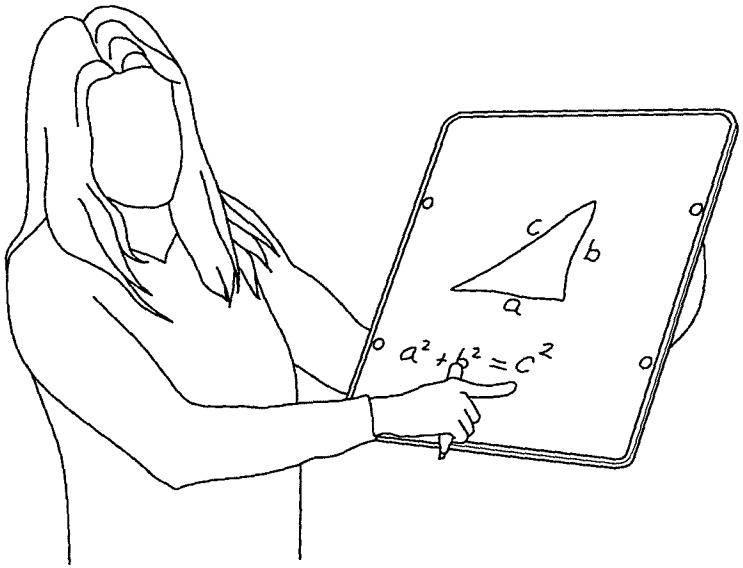
FIG. 5 is an illustration of an armored whiteboard device used as a whiteboard.

The surface layer 16 forms a strike face 36 on the side 22, which includes the markable surface 32. The one or more handles 28 on the opposite side 24 allow the device to be held in one position for writing upon the markable surface 32 (FIG. 5) and in another position with the strike face 36 facing outwardly for protection against penetration by a projectile (FIG. 6).

Figure 4:
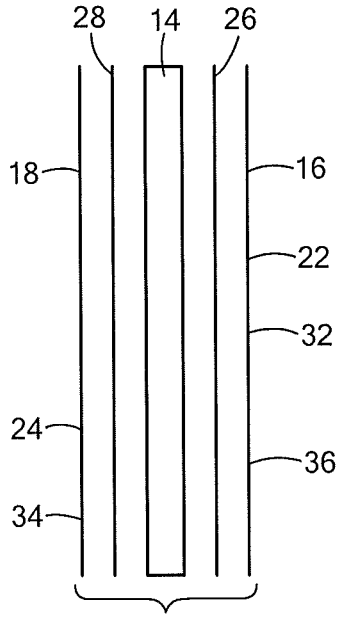
FIG. 4 is an exploded cross-sectional view of an embodiment of an armored whiteboard device according to the present invention.

Each of the markable surfaces 32, 34 is comprised of a substrate that can be written on with, for example, a dry erase, non-permanent, or permanent marker and then wiped clean. The markable surface substrate comprises in whole or in part the surface layer 16 and can be affixed to one side of the ballistic protection layer 14 in any suitable manner, for example, with an adhesive layer 26, as illustrated in FIG. 4. The second markable surface substrate, if present, comprises in whole or in part the surface layer 18 and can be affixed to the opposite side of the ballistic protection layer 14 in any suitable manner, for example, with an adhesive layer 28. The border or edging 26 is placed around the entire periphery of the layers forming the planar device 12. The border protects the edges of the layers from damage and protects a user from sharp edges or fibers, for example, of the ballistic protection layer 14.

Figure 4A:
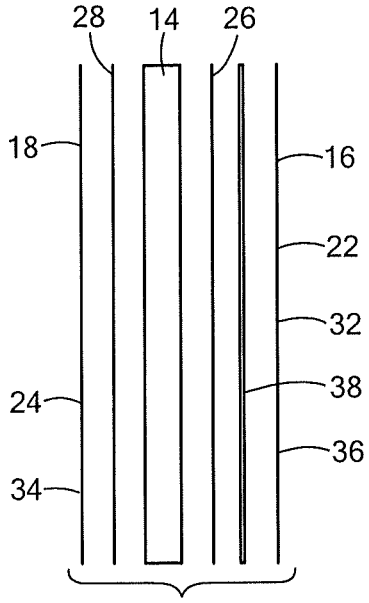
FIG. 4A is an exploded cross-sectional view of a further embodiment of an armored whiteboard device.

As illustrated in FIG. 4A, the surface layer 16 can also include an intermediate layer 38. The markable surface 32 is affixed to the intermediate layer 38 in any suitable manner, and the intermediate layer is then affixed to the ballistic protection layer 14, for example, with the adhesive layer 26. The intermediate layer can provide additional protection against ballistic projectiles and additional structural support for the markable surface. Suitable materials for the intermediate layer include, without limitation, metals, such as steel or aluminum, ceramic, ceramic coated steel, fiberglass, and ultra high molecular weight polyethylene or aramid fibers, such as DYNEEMA® or KEVLAR® fabrics. A steel intermediate layer is also useful for providing magnetic properties to allow magnets to stick to the whiteboard device. A further intermediate layer can also be provided on the other side of the ballistic protection layer if desired.

The markable surface(s) 32, 34 can be formed from a variety of substrate materials. In one embodiment, a markable surface is comprised of a film, or two or more layers of films, of poly(ethylene terephthalate) (PET). The PET film can be opaque or transparent. Opaque films are typically white, as markings in black marker are easily visible on a white surface. However, films in other colors can be used. Typically, an opaque film is covered with a transparent film. Transparent films are also useful with inserts placed behind the film, described further below.

Ceramic, glass, enamel, or porcelain surfaces can also be used for the markable surface substrate. These materials are particularly notable for not absorbing dry erase or permanent markers. In one embodiment, a ceramic or glass can be fired onto a steel layer, for example, the intermediate layer 38. The steel layer can be affixed to the ballistic protection layer with an adhesive layer 26 or in any other suitable manner.

The markable surface substrate can also be comprised of a high gloss paint layer on a suitable intermediate layer, such as a metal layer. A melamine layer can also be used for the markable surface substrate.

The ballistic protection layer 14, which may also be referred to as a catcher layer, can be comprised of a composite material of fibers embedded in a matrix. The fibers can be in the form of fabric sheets of woven or unidirectional fibers. The stacked sheets can be arranged in any suitable orientation of the fibers, such as unidirectional sheets alternating 0°, 90°, etc. The sheets can be stacked and laminated together along with the adhesive layer(s) and the substrate materials for the markable surface(s).

In one embodiment, the ballistic protection layer 14 is comprised of an ultra high molecular weight polyethylene fiber material in a high binding resin, such as a urethane resin. One commercially available suitable material is DYNEEMA® HB-26 material. SPECTRA® material is another commercially available material that may be suitable. Other suitable materials for the ballistic protection layer include composite materials based on fibers of fiberglass, aramid or para-aramid fibers such as KEVLAR® or TWARON®, S-glass, nylon, or carbon. Combinations of fibers can also be used. Resins can be thermoset or thermoplastic resins.

The particular material(s) for the ballistic protection layer 14, the number of laminations, the areal density, and the thickness of the ballistic protection layer can be selected, configured, and sized to prevent penetration by a particular threat level, such as a hand gun, shot gun, or an assault rifle, or a particular National Institute of Justice threat level or a STANAG performance level. For example, a ballistic protection layer of DYNEEMA® HB-26 material, laminated under heat and pressure, having a thickness of 0.20 inch and an areal density of 1.0 lb/ft$^2$ (4900 g/m$^2$) is sufficient to meet the National Institute of Justice Threat Level IIIA. A greater thickness and/or areal density would provide greater protection. The National Institute of Justice publication "Ballistic Resistance of Body Armor NIJ Standard-0101.06," available on the National Institute of Justice website www.oip.usdoj.gov/nij, is incorporated by reference herein.

The strike face 36 and ballistic protection layer 14 can be manufactured in any suitable manner. In one embodiment, the ballistic protection layer, for example, layers of DYNEEMA® material, an adhesive layer and a PET layer are laid up in a press. Heat and pressure are applied to melt the adhesive, and the lamination is then cooled. An acrylic adhesive can be used. In one embodiment, a low melt thermoplastic adhesive can be used that, after the initial application of heat and cooling, converts to a thermoset material. NOLAX® adhesive is a suitable adhesive of this type.

The edging material can be any suitable material, such as a vinyl material. A commercially available self-gripping edge trimming, such as McMaster #24175K45, is suitable.

As noted above, the whiteboard device can include one or more handles 28 on one side 24, which may or may not include a markable surface. Handles enable the whiteboard device to be used conveniently as a hand-held mobile whiteboard. The handles allow the whiteboard to convert readily to a protective device. During use as a whiteboard, one hand can hold the whiteboard device by one of the handles, and the other hand can write on the markable surface. See FIG. 5. The handle or handles can be configured so that an arm can be slipped through, in a configuration similar to an artist's color palette. For protection, the handles can be held adjacent the body with the whiteboard writing surface 32/strike face 36 facing outwardly. See FIG. 6.

In one embodiment, three handles 40*a*, 40*b*, 40*c* are provided arranged in parallel and aligned across a midsection of the side 24. The middle handle 40*a* can be used when a person is writing on the markable side of the device. The outer handles 40*b*, 40*c* can be used when holding the device in a protective position.

The handles can be affixed to the whiteboard device in any suitable manner. In one embodiment, two straps or bars 42 are placed in parallel extending from edge to edge across the surface 18 of the planar device 12. The outer handles 40*b*, 40*c* are attached near the edges of the planar device via fasteners, such as screws or bolts 44, that extend through the layers of the planar device to the strike face side 16. The middle handle 40*a* can be attached directly to the straps 42 with fasteners 46 that attach only to the straps. In this manner, the fasteners 44 only protrude minimally to the strike face side 16, minimizing the decrease in writing surface area. Soft pads 48 can be affixed to the surface adjacent each of the handles to protect the user's knuckles when gripping a handle.

The handles can be manufactured from any suitable material. In one embodiment, the handles are formed from a webbing material of, for example without limitation, nylon or polyester. The webbing material can be covered with a rubber protective covering. The covering can include gripping features, for example, molded into the rubber material.

As noted above, the markable surface(s) 32, 34 can be provided in any desired color, not just white. Similarly, the markable surface(s) can include permanent designs printed thereon. For example, for classroom applications, a design comprising ruled lines for writing letters or numbers can be provided. In other examples, designs comprising a blank calendar form or various game boards can be provided. It will be appreciated that the term "whiteboard" includes surfaces having other colors besides white and/or including designs.

Figure 7:
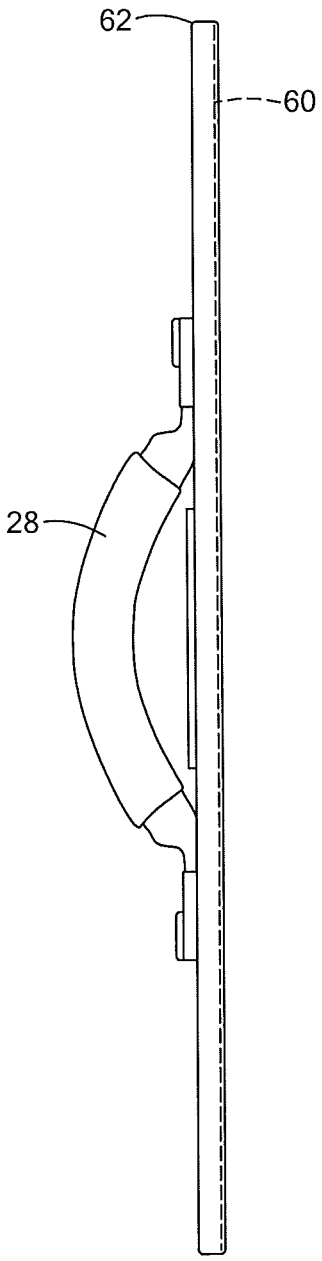
FIG. 7 is an illustration of an armored whiteboard device having a slot therein for receiving inserts.

In one embodiment, the whiteboard device can include a narrow slot 60 formed in the planar device behind and parallel with the transparent markable surface 32 through an opening along an edge 62, generally an upper or side edge. See FIG. 7. An insert in thin sheet form can be slipped into the slot to be visible through the transparent markable surface. The slot can be dimensioned to cover much of the surface area of the markable surface 32. Colored, lined, or graph paper inserts or inserts with various designs printed thereon can be inserted into the slot. For example, lined paper could be used for writing, graph paper for math problems, and game board paper for games. The inserts can be easily changed, providing more versatility to the whiteboard device.

Figure 8:
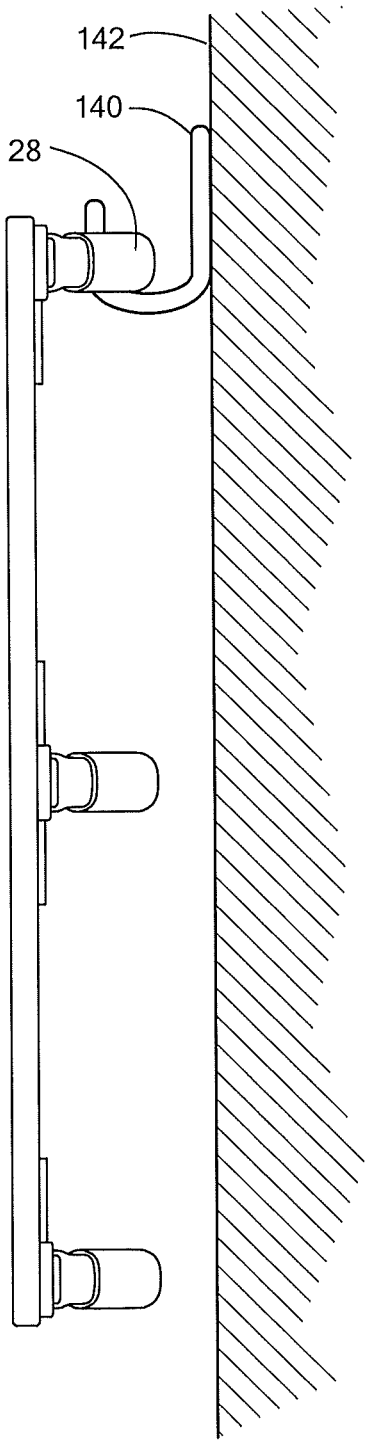
FIG. 8 is a side view of an armored whiteboard device in conjunction with a hook.

A hook 140 can be provided upon which the armored whiteboard device 10 can be hung for use as a whiteboard. See FIG. 8. The hook can be configured to receive one of the handles 28 of the whiteboard device. The hook can be affixed to a wall or door surface 142 in any suitable manner, such as with an adhesive, a mechanical fastener, or the like. If the whiteboard device is needed as a protective device, it can be readily removed from the hook. The armored whiteboard device can also be used as a stand-alone whiteboard by placing it upon a stand, which can also be a roll-around stand.

In another embodiment, the armored whiteboard device 10' can be hung on a mounting or hanging mechanism 240 that includes standoffs 242 that fit through corresponding cutouts 262 through the planar device 12'. The cutouts are located near the corners of the white board device in registration with the standoffs 242. Each standoff 242 is a rod 244 mounted at one end in any suitable manner (for example, with a mechanical fastener 246 such as a screw) to a standoff mounting bar 245 attached to a wall, stand, or the like. A head 248 and a reduced neck 252 are provided at the other end of the rod. Each cutout 262 in the planar device includes a larger opening 264 and at least one smaller opening 266 connected by a pinch point 268 having a width less than the diameter of the smaller opening. The diameter of the larger opening 264 is greater than the diameter of the head 248 of the standoff rod 242. The diameter of the smaller opening 266 is less than the diameter of the head 248 and greater than the diameter of the neck 252. The width of the pinch point 268 is equal to or slightly smaller than the diameter of the neck 252. To mount the whiteboard device 10', the larger opening 264 of each of two cutouts 262 is slipped over the head 248. The planar device 12' is slid so that the neck 252 lies within the smaller opening 266 and the underside of the head 248 can abut against the surface layer 16'. The pinch point 268 provides a friction fit with the neck 252 to provide a lock to retain the rod 244 firmly within the smaller opening. When hung with this mounting mechanism, the whiteboard device is stable during use a as whiteboard. The whiteboard can also remain on the standoffs when struck by a ballistic projectile of the threat level for which the whiteboard device is designed. The whiteboard device can be readily removed by giving the planar device a firm tug in the direction of the larger opening. When removed, the whiteboard device can be held as a protective device as described above. The cutouts 262 can include a second smaller opening 266' connected to the larger opening 264 via a second pinch point 268' at right angles to the first smaller opening 266 and pinch point 268 to allow the whiteboard device to be mounted in either a landscape or a portrait orientation. The standoff mounting bar 245 and standoffs 242 can be located so that the whiteboard device can cover a door or a window. This mounting or hanging mechanism is particularly useful with larger whiteboard devices.

Figure 9:
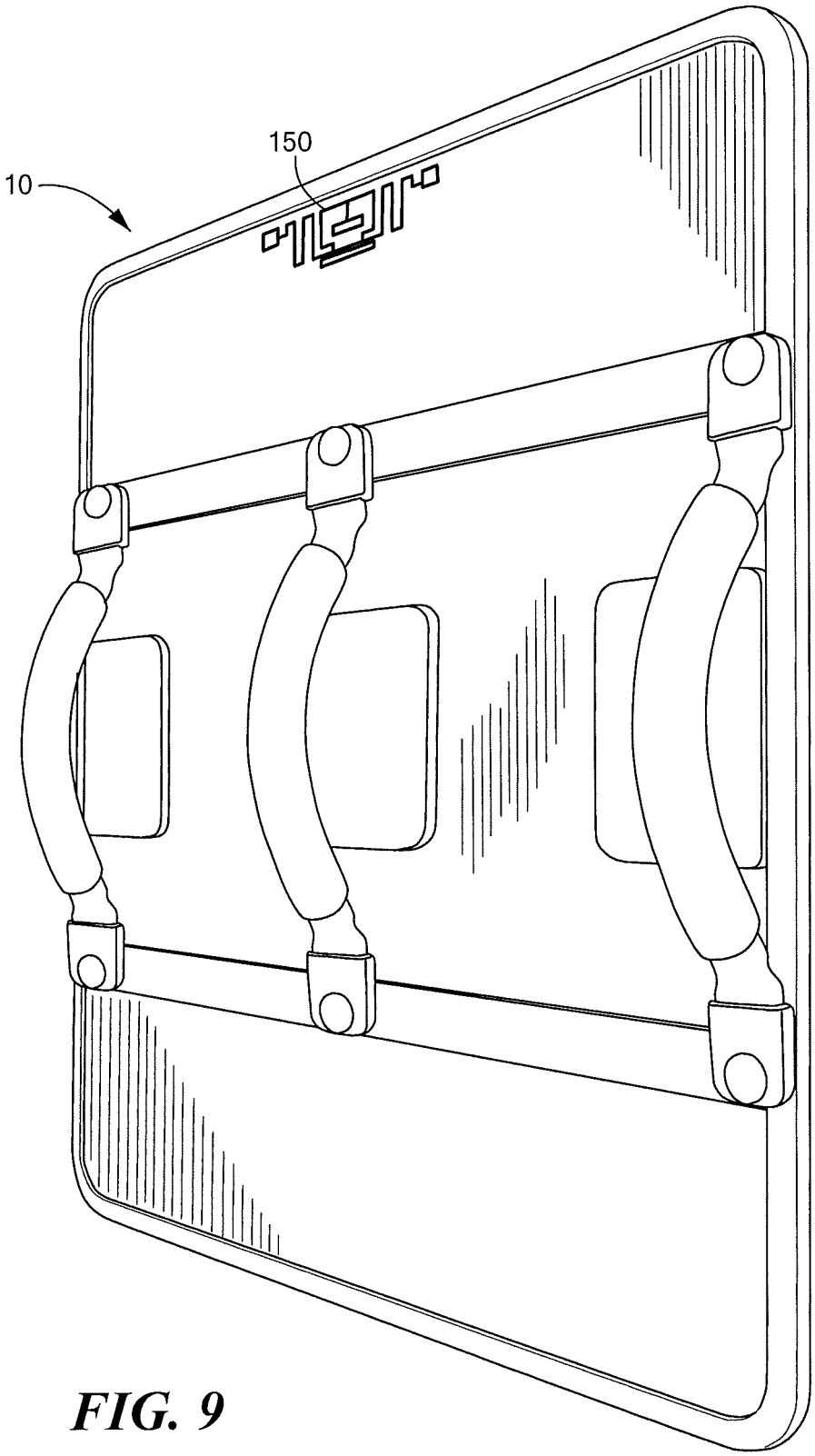
FIG. 9 is a rear isometric view of an embodiment of an armored whiteboard device incorporating circuitry to facilitate various electronic functions.

Circuitry 150 can be embedded in the whiteboard device 10 to facilitate various electronic functions. See FIG. 9. For example, the whiteboard device can incorporate electronic features to enable Wi-Fi or other wireless or wired communication. For example, the armored whiteboard device can incorporate electronic features to function with or as a Wi-Fi-enabled smart board. For example, writing on the markable surface can also appear on a wall-mounted smart board. Alternatively, a whiteboard device suspended from a hook or on a stand, as described above, can be used as a wall mounted smart board.

Also, if a projectile penetrates the strike face, for example, breaking a circuit, the communication-enabled whiteboard device can transmit a signal to a network to so indicate and to provide data identifying the whiteboard device's location. The circuitry can also incorporate an emergency call-for-help device. The call feature can be automated, so that an emergency call is transmitted if the whiteboard device is hit by a projectile. The device can also incorporate an emergency button or cord. The whiteboard device can be trackable using suitable circuitry. The circuitry can be located in the strike face or in an enclosure behind the strike face. A suitable power source, such as a battery, is also provided.

Figure 11:
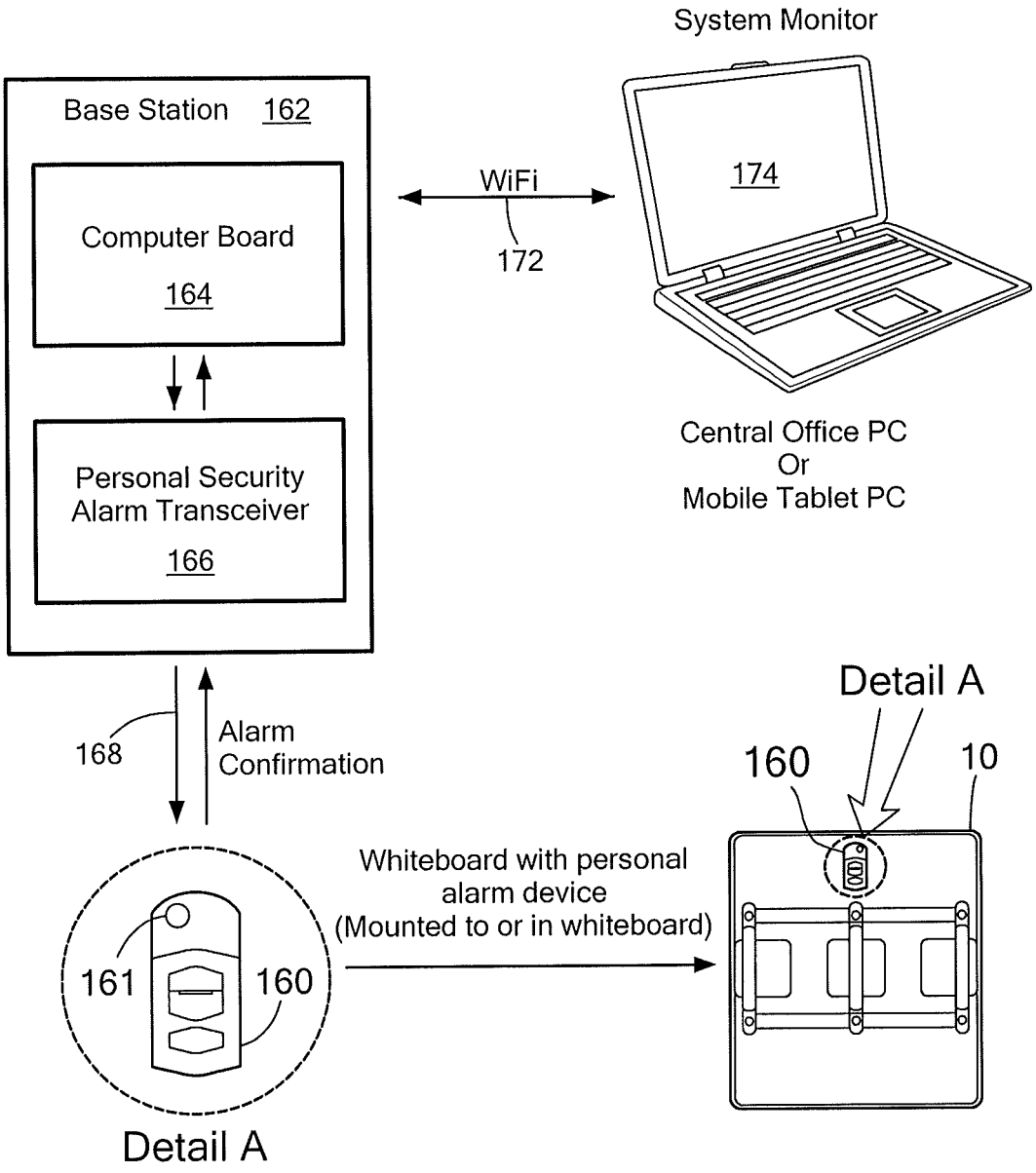
FIG. 11 is a schematic illustration of a whiteboard device with an integrated communication device for communication to a network.

Referring to FIG. 11, each whiteboard device located within an organization or facility, for example, a school, can include a communication device 160, such as a personal alarm or key-fob type device, as is known in the art. The communication device can be mounted to or in the whiteboard device 10. The communication device is operative to communicate with a base station 162 including a computer processor board 164 and a transceiver 166 for receiving signals from and transmitting signals to the communication device 160 over, for example, a network 168, which may be wireless or wired. The base station 162 can be in communication over a network 172, either wireless or wired, with a system monitor 174, such as a computer in a central office or a mobile device, such as a tablet computer. The personal alarm device 160 can also communicate with a cellular or mobile communication network or a GPS system. When a user of a whiteboard device 10 is in an emergency situation, the user can push a button 161 on the communication device 160 to send a signal via the base station to the system monitor. A suitable power source, such as a battery, can be provided in the communication device 160.

Figure 12:
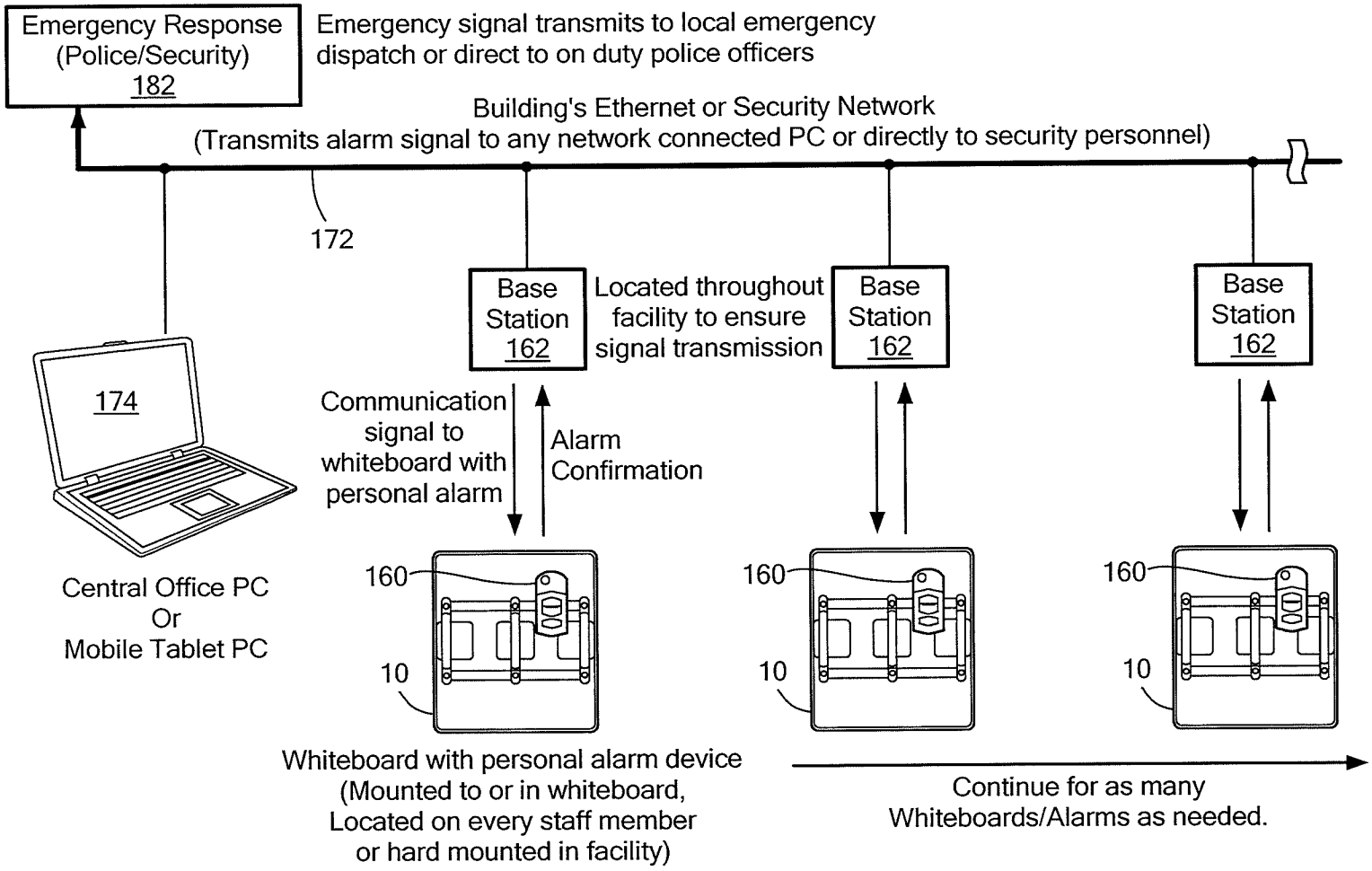
FIG. 12 is a schematic illustration of a network of whiteboard devices with integrated communication devices for communication to a network.
Figure 13:
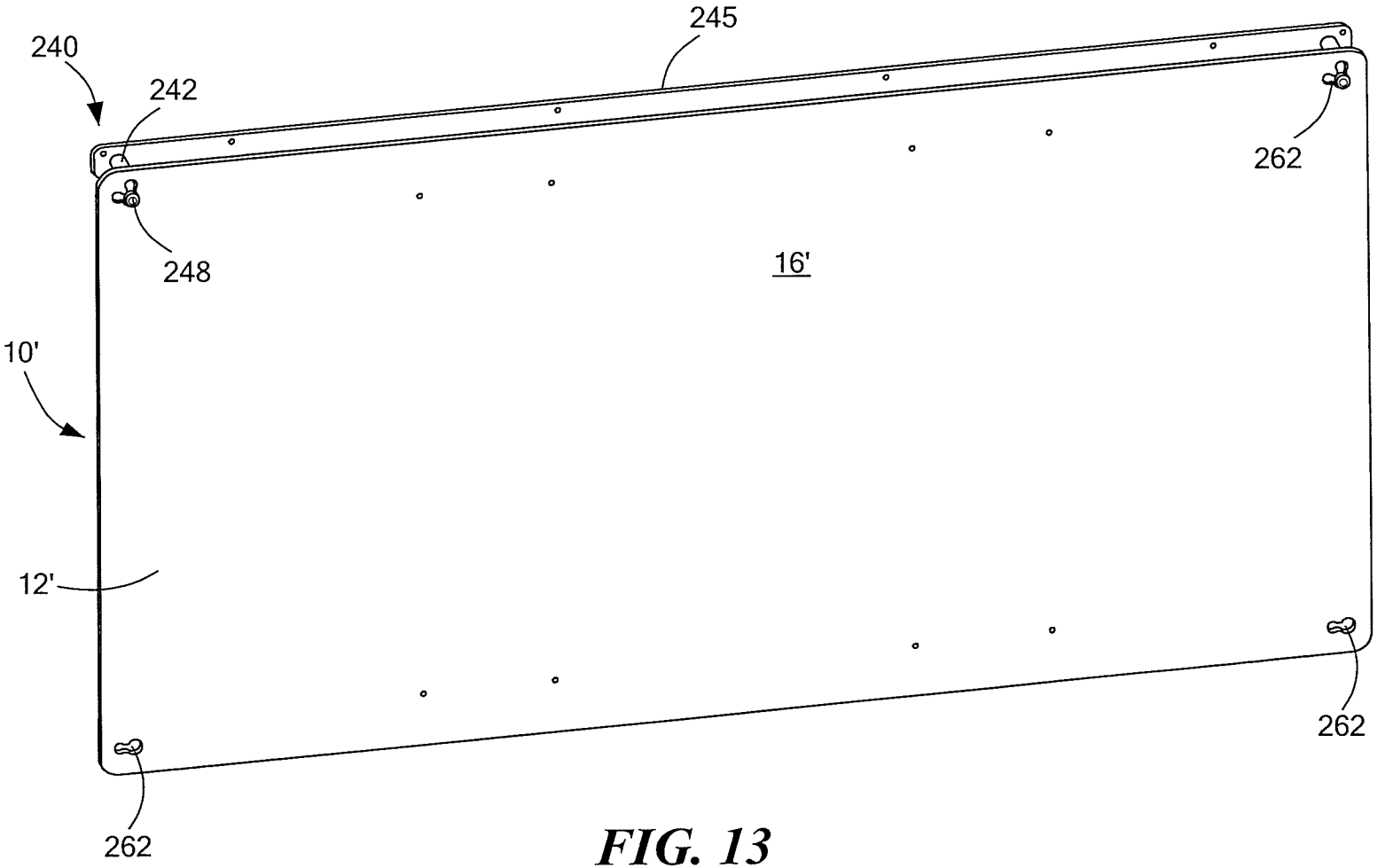
FIG. 13 is an isometric view of a further embodiment of a whiteboard mounting or hanging mechanism.
Figure 14:
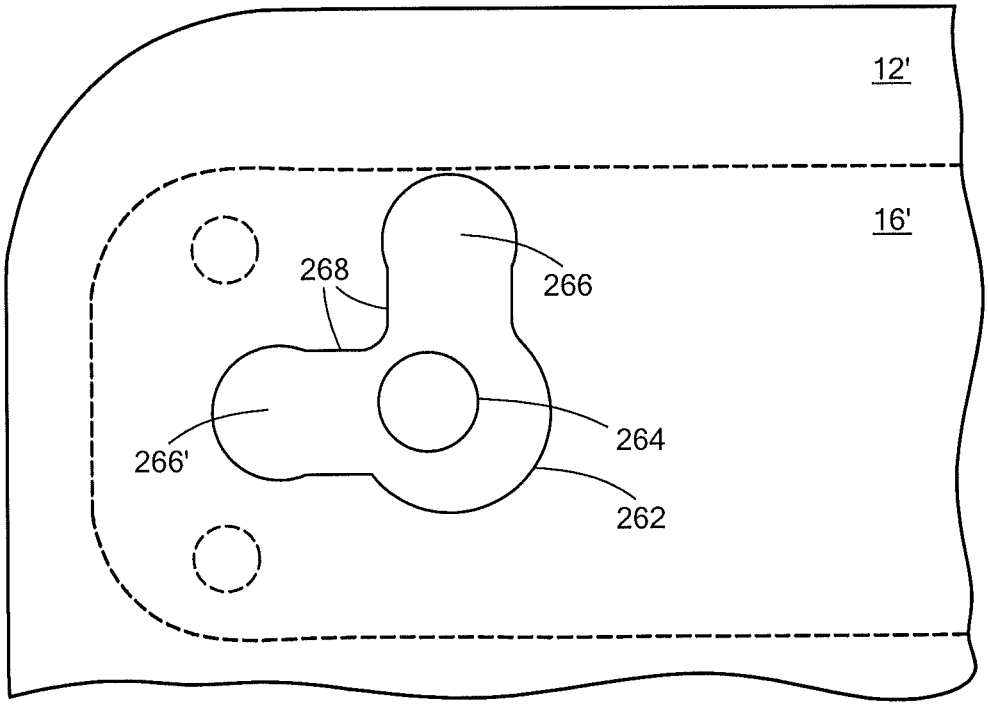
FIG. 14 is a partial plan view of a portion of a mounting or hanging mechanism of FIG. 13.
Figure 15:
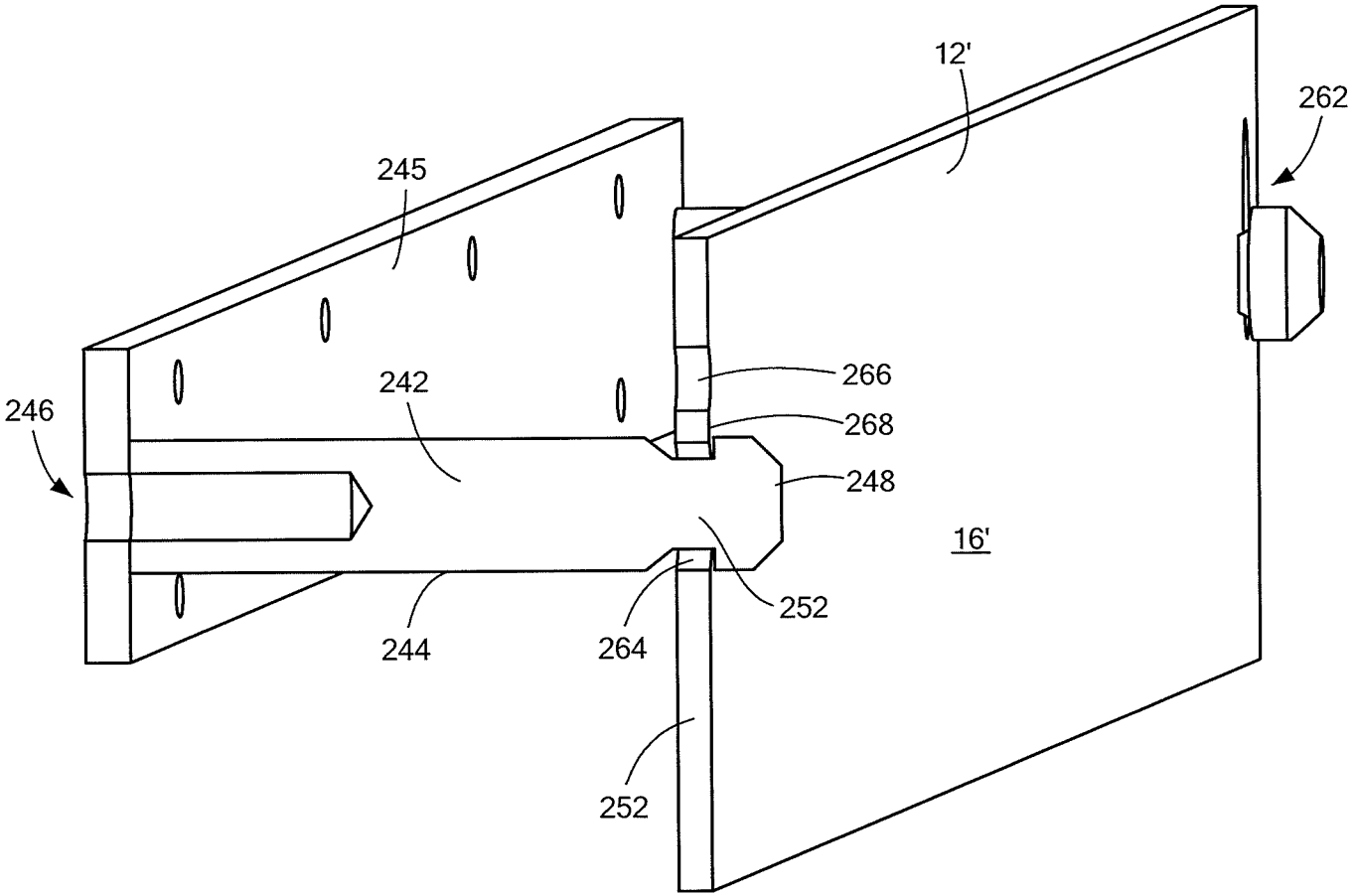
FIG. 15 is a partial isometric view of the mounting or hanging mechanism of FIG. 13.

FIG. 12 illustrates a networked installation in which multiple whiteboard devices 10 in an organization or facility are each provided with a personal alarm device 160. One or more whiteboard devices can communication with a base station 162. If desired or necessary, multiple base stations 162 can be located throughout the facility to ensure sufficient signal transmission. The base stations are in communication with the facility's network 172, for example, an Ethernet or security network. An alarm signal can be transmitted to any desired computer 174 connected to the network or directly to security personnel. An emergency signal can also be transmitted to local law enforcement personnel or emergency responders at a local or regional safety facility 182, such as a police or fire station.

In another embodiment, the whiteboard device can include features such that visual perception of the whiteboard device can create a tactical deception or diversion. For example, graphics or one or more mirrors can be located on parts of the strike face, so that an intruder sees something unexpected.

Figure 10:
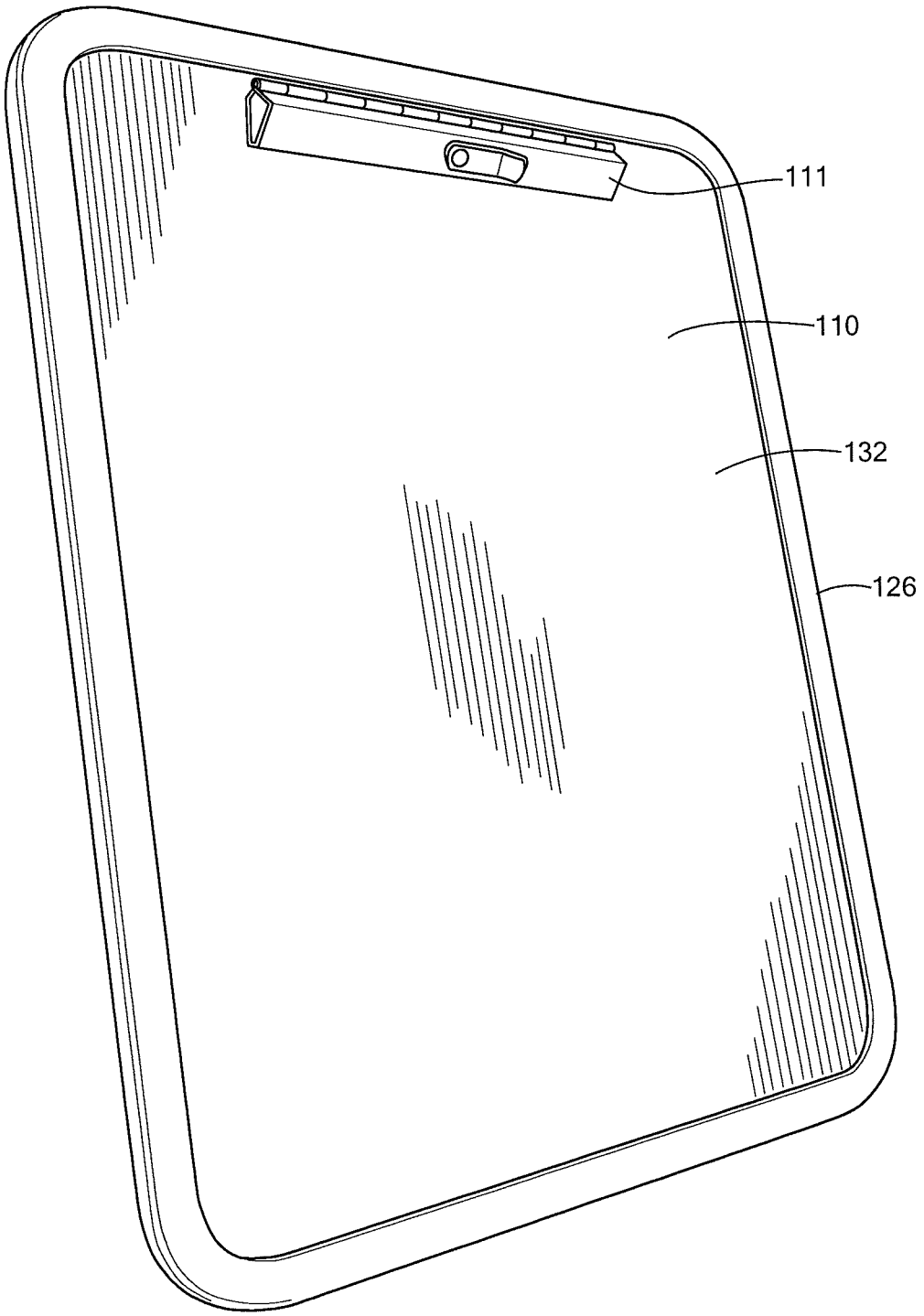
FIG. 10 is a front perspective view of an embodiment of an armored clipboard device according to the present invention.

In another aspect, the armored whiteboard device can be embodied in the form of a clipboard device 110, illustrated in FIG. 10. Such a clipboard device typically would not include handles, such as described above, although in some embodiments, one or more handles could be included. The clipboard device includes a clip mechanism 111 on one side for attaching papers. A ballistic protection layer is sandwiched between surface layers, one or both of which can include a dry erase markable surface 132, as described above. A border or edging 126 surrounds the periphery of the clipboard device, as described above. Alternatively, a clip mechanism can be added to the whiteboard device 10 described above.

It will be appreciated that the various features described herein can be combined with each other in various ways. The device can incorporate further layers of various materials. The invention is not to be limited by what has been particularly shown and described, except as indicated by the appended claims.

What is claimed is:

1. An armored whiteboard device comprising:

a flat planar device having a layered arrangement with two opposite parallel sides, comprising:

a protection layer comprised of a ballistic material, and two surface layers, each surface layer arranged on a respective side of the protection layer, a first surface layer of the two surface layers comprising a strike face and a dry erase markable surface that can be written on and wiped clean; and one or more handles affixed to the planar device on a second surface layer of the two surface layers, on the side of the planar device opposite the strike face and the markable surface of the first surface layer.

2. The device of claim 1, wherein the handles comprise three handles, one handle disposed in a middle region of the second surface layer, two handles disposed along edges of the second surface layer.

3. The device of claim 1, further comprising a pad on the second surface layer beneath one or more of each of the handles.

4. The device of claim 1 further comprising a protective border around the periphery of the planar device.

5. The device of claim 1, wherein the second surface layer of the two surface layers comprises a dry erase markable surface that can be written on and wiped clean.

6. The device of claim 1, wherein the dry erase markable surface comprises a film of poly(ethylene terephthalate), a ceramic material, a glass material, an enamel material, a porcelain material, a melamine material, or a painted surface.

7. The device of claim 1, wherein the dry erase markable surface is opaque, white, colored, or transparent.

8. The device of claim 1, wherein the strike face includes an intermediate layer between the dry erase markable surface and the protection layer.

9. The device of claim 8, wherein the intermediate layer comprises a metal layer.

10. The device of claim 9, wherein the metal of the intermediate layer comprises steel or aluminum.

11. The device of claim 1, wherein the first surface layer is attached to the ballistic protection layer with a low melt thermoplastic adhesive that converts to a thermoset material upon a first heating and cooling.

12. The device of claim 1, wherein the protection layer is comprised of a composite material comprising layers of woven or unidirectional fibers in sheet form embedded in a resin matrix.

13. The device of claim 1, wherein the composite material comprises fibers of a high molecular weight polyethylene in a resin matrix.

14. The device of claim 1, wherein the ballistic material of the protection layer has a thickness of at least 0.2 inch.

15. The device of claim 1, wherein the ballistic material of the protection layer has an areal density of at least 1.0 $lb/ft^2$.

16. The device of claim 1, wherein the ballistic material of the protection layer has a thickness and areal density selected to provide protection against a National Institute of Justice threat level IIIA.

17. The device of claim 1, further including a slot disposed in the planar device parallel to the first surface layer, the slot configured to receive an insert in sheet form having a color or printed material thereon, and wherein the dry erase markable surface is transparent so that the insert is visible through the dry erase markable surface when inserted into the slot.

18. The device of claim 1, further including a hook mountable on a wall or door surface, the hook configured to receive one of the handles of the device to hang the device vertically upon the wall or door surface.

19. The device of claim 1, further comprising circuitry embedded in the planar device, the circuitry operative to enable communication with a network.

20. The device of claim 19, wherein the communication includes data indicative of damage to the strike face or the ballistic protection layer, data indicative of a location of the device, or data indicative of a call for help.

21. The device of claim 1, further comprising smart board circuitry embedded in the planar device.

22. The device of claim 1, further comprising a communication device mounted to or in the planar device, the communication device in communication with a network and operative to send and receive signals indicative of an emergency situation.

23. The device of claim 1, further comprising a mounting mechanism comprising rods mountable to a structural element, the rods cooperative with cutouts of the planar device.

24. The device of claim 1, wherein:

the second surface layer comprises a dry erase markable surface that can be written on and wiped clean;

the dry erase markable surfaces of the first surface layer and of the second surface layer each comprise a film of poly(ethylene terephthalate);

the protection layer is comprised of a composite material comprising a lamination of unidirectional fibers of a high molecular weight polyethylene in sheet form embedded in a resin matrix;

the handles comprise three parallel handles aligned across a midsection of the second surface layer, one handle disposed in a middle region and two handles disposed along edges of the second surface layer; and a protective border is disposed around the periphery of the planar device.

* * * * *